US009065180B2

(12) United States Patent
De Barros et al.

(10) Patent No.: US 9,065,180 B2
(45) Date of Patent: Jun. 23, 2015

(54) SURFACE FOR FILTERING A PLURALITY OF FREQUENCY BANDS

(75) Inventors: Fabien De Barros, Grenoble (FR); Guy Eymin-Petot-Tourtollet, Tencin (FR); Pierre Lemaitre-Auger, Malissard (FR); Tân-Phu Vuong, Grenoble (FR)

(73) Assignees: INSTITUT POLYTECHNIQUE DE GRENOBLE (FR); CENTRE TECHNIQUE DE L'INDUSTRIE DES PAPIERS, CARTONS ET CELLULOSES (FR)

( * ) Notice: Subject to any disclaimer, the term of this patent is extended or adjusted under 35 U.S.C. 154(b) by 418 days.

(21) Appl. No.: 13/643,787

(22) PCT Filed: Apr. 13, 2011

(86) PCT No.: PCT/FR2011/050843

§ 371 (c)(1),
(2), (4) Date: Feb. 6, 2013

(87) PCT Pub. No.: WO2011/135224

PCT Pub. Date: Nov. 3, 2011

(65) Prior Publication Data

US 2013/0127651 A1 May 23, 2013

(30) Foreign Application Priority Data

Apr. 27, 2010 (FR) ..... 10 53217

(51) Int. Cl.
*H01Q 15/00* (2006.01)

(52) U.S. Cl.
CPC ..... *H01Q 15/0013* (2013.01)

(58) Field of Classification Search
CPC ..... H01Q 15/0013
USPC ..... 342/4
See application file for complete search history.

(56) References Cited

U.S. PATENT DOCUMENTS 3,148,370 A 9/1964 Bowman (Continued)

FOREIGN PATENT DOCUMENTS

GB 2460288 A 11/2009
JP 2005142298 A 6/2005

OTHER PUBLICATIONS

Pastor Jimenez, J., "International Application No. PCT/FR2011/050843 Written Opinion of the International Searching Authority", Aug. 4, 2011, Publisher: PCT, Published in: FR.

(Continued)

*Primary Examiner* — Timothy A Brainard
(74) *Attorney, Agent, or Firm* — Kaplan Breyer Schwarz & Ottesen, LLP

(57) ABSTRACT

The invention relates to a surface suitable for filtering a plurality of frequency bands, said surface including a set of separate identical basic conductive units (31) that are reproduced in a periodic arrangement on a dielectric substrate (10). The basic unit includes: a tripole consisting of three identical segments (12) that extend radially from a center (14); and two arms (32) that extend symmetrically from an intermediate point of each segment, said intermediate point being located at a common distance ($D_b$) from the center (14) for each of the segments (12). The general directions of both arms form an angle of approximately 120° and define an arrowhead pointed toward the outside, wherein the arms (32) corresponding to two separate segments (12) do not intersect.

11 Claims, 3 Drawing Sheets

(56) References Cited

U.S. PATENT DOCUMENTS

| | | | | |
|---|---|---|---|---|
| 4,126,866 | A | 11/1978 | Pelton | |
| 5,161,068 | A * | 11/1992 | Spry | 359/885 |
| 2004/0252054 | A1 | 12/2004 | Brown et al. | |
| 2005/0012677 | A1 * | 1/2005 | Brown et al. | 343/909 |
| 2008/0150691 | A1 * | 6/2008 | Knadle et al. | 340/10.1 |

OTHER PUBLICATIONS

Hill, et al.: "The Effect of Perturbating a Frequency-Selective Surface and Its Relation to the Design of a Dual-Band Surface," IEEE Transactions on Antennas and Propagation, vol. 44, No. 3, Mar. 1996, pp. 368-374.

French Search Report of International Application No. PCT/FR2011/050843.

* cited by examiner

SURFACE FOR FILTERING A PLURALITY OF FREQUENCY BANDS

FIELD OF THE INVENTION

The present disclosure relates to a frequency-selective surface, that is, a surface capable of shielding electromagnetic waves belonging to certain frequency bands.

DISCUSSION OF PRIOR ART

Frequency-selective surfaces are generally called FSS in the art. They comprise a set of identical elementary conductive patterns, repeated according to a periodic layout on a surface of a dielectric support. The shape and the dimensions of the elementary pattern, the arrangement of the periodic layout, and the characteristics of the conductive material of the pattern and of the dielectric material of the support are the main factors determining the filtering properties of the surface.

One of the targeted applications relates to the selective shielding of a building or of a room of a building against certain electromagnetic waves. The frequencies which are generally desired to be filtered especially comprise the carrier frequencies of GSM-type mobile telephony systems (0.9, 1.8, and 2.1 GHz), as well as the carrier frequencies of Wi-Fi-type wireless computer network systems (2.4 and 5.4 GHz).

The dielectric support may be a substrate based on epoxy or on plastic on which the conductive patterns are formed by deposition of conductive layers, according to manufacturing methods similar to printed circuit manufacturing methods. It has also been provided to form frequency-selective surfaces directly on paper- or cardboard-type supports, for example, by printing with a conductive ink. This last embodiment especially has the advantage of significantly decreasing the cost of such surfaces.

FIG. 1 is a top view schematically showing an elementary conductive pattern 1 of a frequency-selective surface. Pattern 1, formed on a surface of a dielectric support 10, is a tripole formed of three identical segments 12*a*, 12*b*, and 12*c* of length $L_s$, extending in a star from a center 14. Segments 12*a* to 12*c* form, two-by-two, angles of approximately 120°.

FIG. 2 is a top view schematically showing a portion of a frequency-selective surface formed by the repeating, according to a periodic layout on dielectric support 10, of elementary pattern 1 of FIG. 1. Pattern 1 is repeated by translation along each of the directions of segments 12*a* to 12*c* of the tripole, so that a same non-zero distance $D_m$ separates each outer end of a segment of a pattern from the center of a neighboring pattern. The translation is repeated until it covers the entire targeted surface.

The surface thus formed has a resonance frequency essentially depending on the parameters relative to length $L_s$ of the tripole segments and to distance $D_m$ between neighboring patterns. Such a surface has the property of filtering the electromagnetic waves belonging to a frequency band centered on its resonance frequency. The filtering efficiency also depends on width W and on the thickness (not shown in the drawing) of the pattern, as well as on the thickness (not shown in the drawing) of dielectric support 10.

A disadvantage of the frequency-selective surface described in relation with FIGS. 1 and 2 is that its frequency response depends on the angle of incidence of the electromagnetic waves with respect to the surface, as well as on the polarization of the incident electromagnetic waves.

Further, this surface only enables to filter a single frequency band centered on its resonance frequency. Thus, to filter different bands, for example GSM frequencies (on the order of 0.9, 1.8, and 2.1 GHz) and/or Wi-Fi frequencies (on the order of 2.4 and 5.4 GHz), frequency-selective surfaces adapted to each of the targeted bands should be stacked.

SUMMARY

Thus, an object of an embodiment of the present invention is to provide a frequency-selective surface overcoming at least some of the disadvantages of existing solutions.

An object of an embodiment of the present invention is to provide such a surface having filtering properties independent from the angle of incidence and from the polarization of incident electromagnetic waves.

An object of an embodiment of the present invention is to provide such a surface which is capable of filtering several different frequency bands.

An object of an embodiment of the present invention is to provide such a surface having a relatively low conductive pattern coverage rate.

Thus, an embodiment of the present invention provides a surface capable of filtering a plurality of frequency bands, this surface comprising a set of separate identical elementary conductive patterns, repeated according to a periodic layout on a dielectric support, the elementary pattern comprising: a tripole formed of three identical segments extending in a star from a center; and two branches extending symmetrically from an intermediate point of each segment, this intermediate point being located at a same distance from the center for each of the segments, the general directions of the two branches forming an angle of approximately 120° and defining an outward-pointing arrowhead, the branches associated with two different segments being non-secant.

According to an embodiment of the present invention, the segments of the tripole form, two-by-two, angles of approximately 120°.

According to an embodiment of the present invention, the elementary pattern further comprises two first identical fins extending symmetrically from the end of each segment, the first fins forming an angle of approximately 120° and defining an arrowhead directed towards the outside of the pattern.

According to an embodiment of the present invention, the elementary pattern further comprises two first identical fins extending from the free end of each branch, each second fin forming an angle of approximately 60° with the general direction of the branch.

According to an embodiment of the present invention, the second fins of each branch form together an angle of approximately 120° and defining an arrowhead directed towards the outside of the pattern.

According to an embodiment of the present invention, the second fins of each branch are aligned along a same direction, this direction intersecting the direction of the segment from which the branch originates.

According to an embodiment of the present invention, the branches comprise at least one crenel-shaped extension along a direction intersecting the general direction of the branch.

According to an embodiment of the present invention, the elementary pattern is repeated by translation along each of the directions of the segments of the tripole so that a same distance separates each end of a segment of a pattern from the center of a neighboring pattern.

According to an embodiment of the present invention, the surface is capable of filtering three frequency bands respectively centered on 0.9, 1.8, and 2.1 GHz.

According to an embodiment of the present invention, the surface is capable of filtering two frequency bands respectively centered on 2.4 and 5.4 GHz.

According to an embodiment of the present invention, the dielectric support is a paper- or cardboard-type support and the conductive patterns are formed by printing with a conductive ink.

Another embodiment of the present invention provides a use of the above-mentioned surface to filter three frequency bands located within the range from 0.9 to 5.4 GHz, wherein the overall dimensions of an elementary pattern approximately range from 1 to 10 centimeters, the lengths of each of these segments, branches, and fins being adjusted to select the three targeted frequency bands.

BRIEF DESCRIPTION OF THE DRAWINGS

The foregoing and other objects, features and advantages of the present invention will be discussed in detail in the following non-limiting description of specific embodiments in connection with the accompanying drawings, among which.

DETAILED DESCRIPTION

Figure 1:
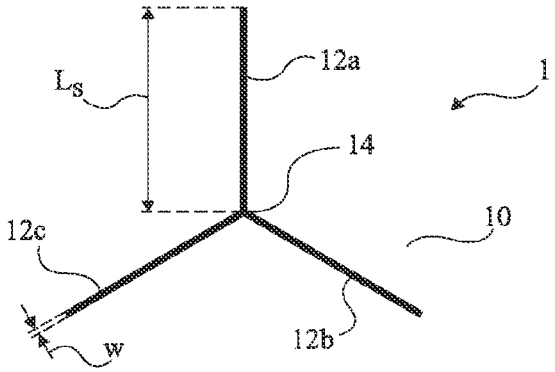
FIG. 1, previously-described, is a top view schematically showing an elementary conductive pattern of a frequency-selective surface.
Figure 2:
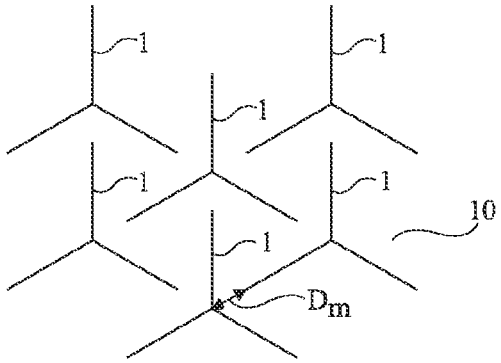
FIG. 2, previously-described, is a top view schematically showing a portion of a frequency-selective surface formed by repeating of the elementary pattern of FIG. 1.

For clarity, the same elements have been designated with the same reference numerals in the different drawings and, further, the various drawings are not to scale.

Figure 3:
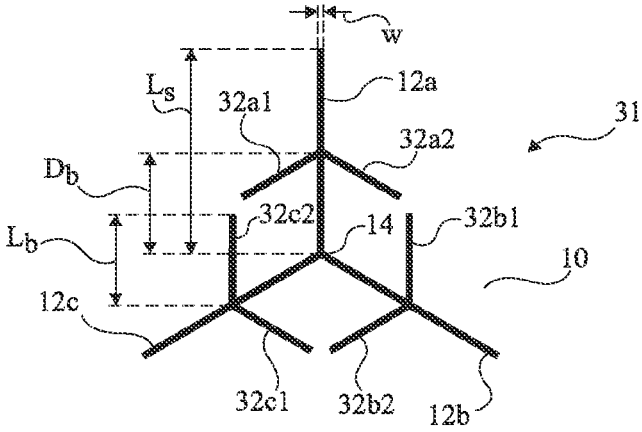
FIG. 3 is a top view schematically showing an embodiment of an elementary conductive pattern of a frequency-selective surface.

FIG. 3 is a top view schematically showing an embodiment of an elementary conductive pattern 31 of a frequency-selective surface.

As an example, the conductive material may be aluminum, gold, copper, silver, carbon, iron, platinum, graphite, or a conductive alloy of several of these materials. Generally, the higher the electric conductivity of the material, the better the filtering performed by the surface.

Pattern 31, formed on a surface of a dielectric support 10, comprises a basic tripole formed of three approximately identical segments 12*a*, 12*b*, and 12*c* of length $L_s$, extending in a star from a center 14. Segments 12*a* to 12*c* form, two-by-two, angles of approximately 120°, for example, ranging between 110 and 130°.

Pattern 31 further comprises, for each segment 12*a*, 12*b*, 12*c*, two substantially identical branches, respectively 32*a*1 and 32*a*2, 32*b*1 and 32*b*2, and 32*c*1 and 32*c*2, extending from an intermediate point of the segment, substantially symmetrically with respect to the segment direction. In this example, branches 32 have the shape of bars with a length $L_b$. On each segment 12, the intermediate point is located approximately at a same distance $D_b$ from center 14. The general directions of the two branches 32 form an angle of approximately 120°, for example, ranging between 110 and 130°, and defining an arrowhead directed towards the outside of the pattern. Further, branches 32 associated with two different segments 12 are non secant.

Figure 4:
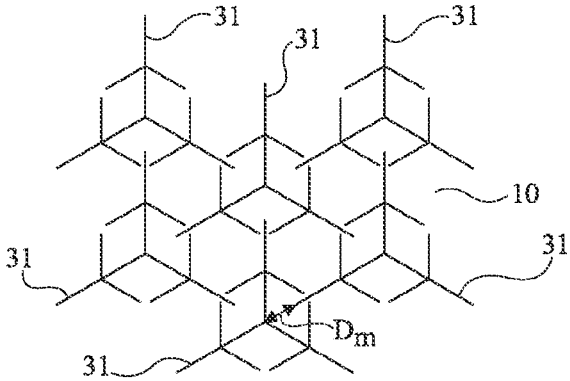
FIG. 4 is a top view schematically showing a portion of a frequency-selective surface formed by repeating of the elementary pattern of FIG. 3.

FIG. 4 is a top view schematically showing a portion of an embodiment of a frequency-selective surface formed by the repeating, according to a periodic layout on dielectric support 10, of elementary pattern 31 of FIG. 3. Pattern 31 is repeated by translation along each of the directions of segments 12*a* to 12*c* of the basic tripole, so that a same non-zero distance $D_m$ separates each outer end of a segment of a pattern 31 from center 14 of a neighboring pattern 31. The translation operation is repeated until the entire targeted surface is covered. It should be noted that the dimensions of the elementary pattern and distance $D_m$ are selected to be such that the elementary patterns are separate.

The frequency response of the surface thus formed essentially depends on length $L_s$ of segments 12, on length $L_b$ of branches 32, on distance $D_b$ between the intermediate starting point of branches 32 of a segment 12 and center 14 of the pattern, and on distance $D_m$ between neighboring patterns.

The inventors have observed that such a surface has three main resonance frequencies. The first resonance frequency essentially depends on length $L_s$ of segments 12 and on distance $D_m$ between neighboring patterns. The second resonance frequency essentially depends on length $L_b$ of branches 32 and on distance $D_b$ between center 14 of the pattern and the intermediate point of segment 12 from which the branches originate. The third resonance frequency depends on all the above-mentioned parameters.

Such a surface has the property of filtering the electromagnetic waves belonging to three different frequency bands centered on its three main resonance frequencies. In practice, a simulation software is used to test different combinations of parameters by performing progressive adjustments to obtain a set of parameters adapted to the targeted frequency bands.

In the embodiment of FIG. 4, the setting of the first and second resonance frequencies is relatively easy, but it is difficult to adjust the third resonance frequency without modifying the first two frequencies.

Further, the three resonance frequencies of the surface of FIG. 4 remain slightly dependent on the angle of incidence and on the polarization of electromagnetic waves.

Figure 5:
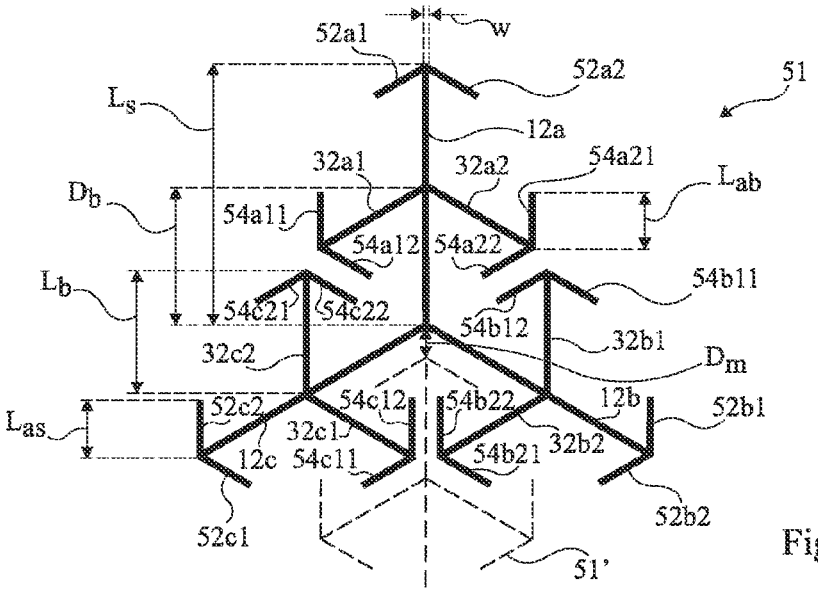
FIGS. 5 to 9 are simplified top views showing different alternative embodiments of the elementary conductive pattern of FIG. 3.

FIG. 5 is a top view schematically showing another embodiment of an elementary conductive pattern 51 of a frequency-selective surface. Pattern 51 shows all the elements of pattern 31 of FIG. 3. It further comprises two substantially identical fins of length $L_{as}$, respectively 52*a*1 and 52*a*2, 52*b*1 and 52*b*2, and 52*c*1 and 52*c*2, extending from the outer end of each segment 12, substantially symmetrically with respect to the segment direction. Fins 52 of each segment 12 form together an angle of approximately 120°, for example, ranging between 110 and 130°, and define an arrowhead directed towards the outside of the pattern.

In an embodiment, pattern 51 further comprises two substantially identical fins of length $L_{ab}$, respectively 54*a*11 and 54*a*12, 54*a*21 and 54*a*22, 54*b*11 and 54*b*12, 54*b*21 and 54*b*22, 54*c*11 and 54*c*12, and 54*c*21 and 54*c*22, extending from the outer end of each branch 32 (on the side of the branch opposite to the segment from which it originates), substantially symmetrically with respect to the general branch direction. Fins 54 of each branch 32 form together an angle of approximately 120°, for example, ranging between 110 and 130°, and define an outward-pointing arrowhead. The pattern dimensions are selected so that fins associated with different segments or branches are not secant and do not intersect the other segments and branches of the pattern.

FIG. 5 shows, in dotted lines, a portion of a pattern 51' corresponding to a translation of pattern 51 along the direction of segment 12*a* of pattern 51. In this example, fins 52 of the segment of pattern 51' closest to center 14 of pattern 51 are located in the space delimited by segments 12*b* and 12*c* and by branches 32*b*2 and 32*c*1 of pattern 51. A non-zero distance $D_m$ separates center 14 of pattern 51 from the end of the closest segment 12. It should be understood that other patterns (not shown) of a frequency-selective surface are formed similarly, by translation along the directions of the other segments 12, according to a periodic layout of the type described in relation with FIG. 4.

The surface thus formed has three main distinct resonance frequencies. These three resonance frequencies are independent from the angle of incidence and from the polarization of electromagnetic waves. Further, the introduction of additional parameters $L_{as}$ and $L_{ab}$ relative to the length of fins 52 and 54 increases resonance frequency setting possibilities.

The strong interleaving of the elementary patterns is considered to contribute to ensuring a behavior of the surface independent from the angle of incidence and from the polarization of electromagnetic waves. Thus, it will be ascertained to maintain parameter $D_m$ relative to the distance between neighboring patterns relatively low.

Figure 6:
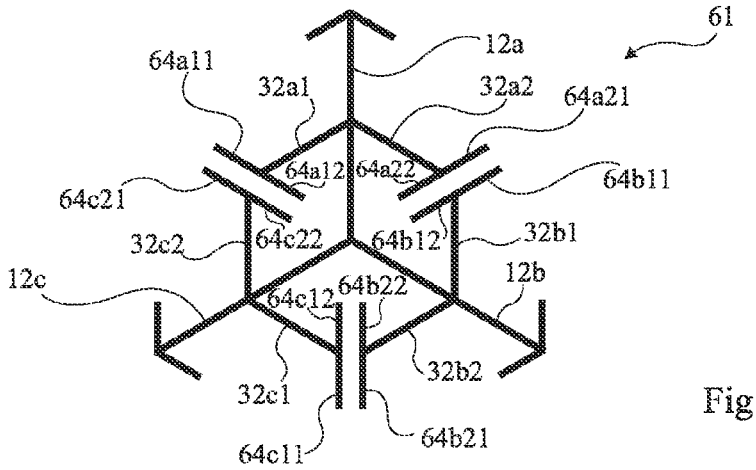

FIG. 6 is a top view schematically showing an alternative embodiment of the elementary conductive pattern of FIG. 5. Pattern 61 of FIG. 6 differs from the pattern of FIG. 5 by the orientation of the fins associated with branches 32. In pattern 61, two identical fins 64 (respectively 64*a*11 and 64*a*12, 64*a*21 and 64*a*22, 64*b*11 and 64*b*12, 64*b*21 and 64*b*22, 64*c*11 and 64*c*12, and 64*c*21 and 64*c*22) associated with a branch 32 each form an angle of approximately 60°, for example, ranging between 55 and 65°, with the general branch direction, and are substantially aligned along a same direction, this direction intersecting the direction of segment 12 from which branch 32 originates.

Like pattern 51 of FIG. 5, pattern 61 provides surfaces with three resonance frequencies. It especially enables to obtain resonance frequencies different from those obtained from pattern 51, and has the same setting possibilities and the same insensitivity to the orientation and to the polarization of electromagnetic waves as pattern 51.

Figure 7:
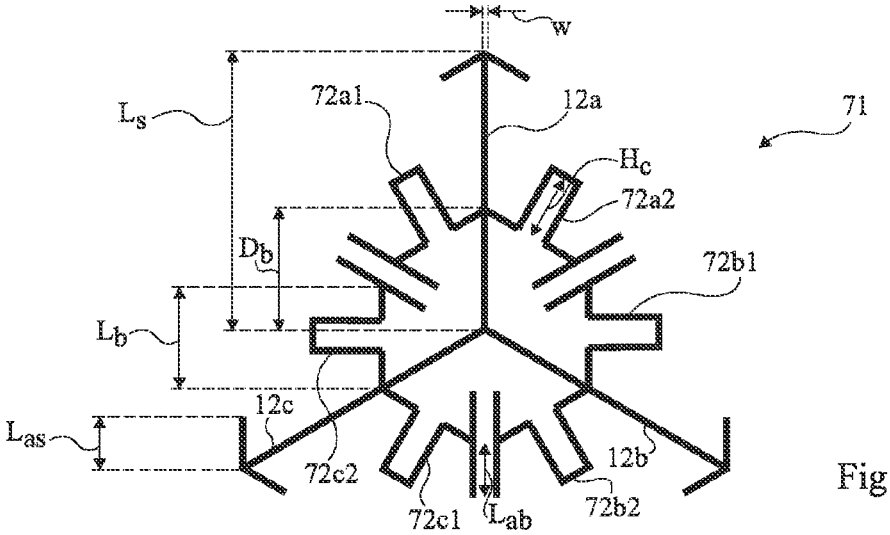

FIG. 7 is a top view schematically showing an alternative embodiment of the elementary conductive pattern of FIG. 6. Pattern 71 of FIG. 7 differs from the pattern of FIG. 6 by the shape of the branches originating from segments 12. Pattern 71 comprises two branches 72 (respectively 72*a*1 and 72*a*2, 72*b*1 and 72*b*2, and 72*c*1 and 72*c*2) extending from an intermediate point of each segment 12 along the same general direction as branches 32 of the pattern of FIG. 6. However, unlike branches 32 of the pattern of FIG. 6, branches 72 comprise a crenel-shaped extension of height $H_c$, extending along a direction approximately orthogonal to the general branch direction, towards the outside of the pattern.

Like pattern 61 of FIG. 6, pattern 71 provides surfaces with three resonance frequencies. The provision of a crenel-shaped extension on branches 72 enables to vary the length of the branches more, which increases resonance frequency setting possibilities. Further, in the same way as for patterns 51 and 61 of FIGS. 5 and 6, the resonance frequencies of the surfaces obtained from pattern 71 are insensitive to the orientation and to the polarization of electromagnetic waves.

As an example, by repeating pattern 71 according to a periodic layout of the type described in relation with FIG. 4, the inventors have obtained a surface capable of shielding frequencies on the order of 0.9 and 1.8 GHz, by using the following parameters:

| Parameter | $L_s$ | $D_b$ | $D_m$ | $L_b$ | W | $L_{as}$ | $L_{ab}$ | $H_c$ |
|---|---|---|---|---|---|---|---|---|
| Value (mm) | 25 | 9.1 | 0.75 | 7.5 | 0.5 | 4 | 5.75 | 5.9 |

The inventors have further obtained a surface capable of shielding frequencies on the order of 2.4 and 5.4 GHz by using the following parameters:

| Parameter | $L_s$ | $D_b$ | $D_m$ | $L_b$ | W | $L_{as}$ | $L_{ab}$ | $H_c$ |
|---|---|---|---|---|---|---|---|---|
| Value (mm) | 9.6 | 3.6 | 0.5 | 2.9 | 0.25 | 2 | 1.6 | 1.8 |

The two above examples do not consider the third resonance frequency, which however exists.

Figure 8:
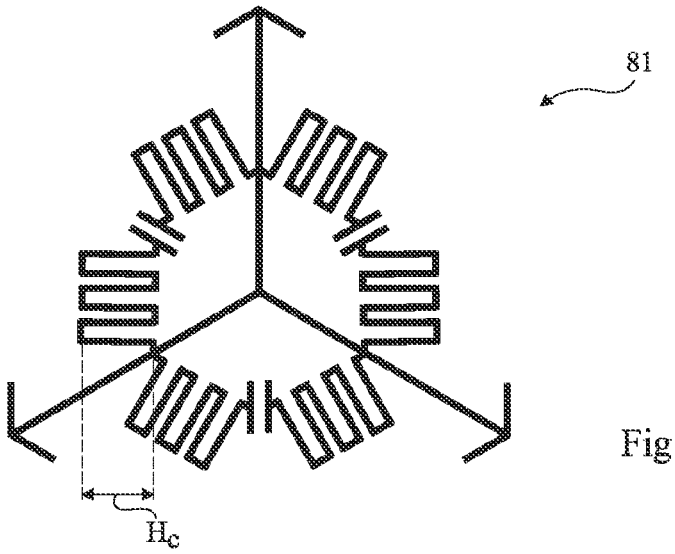

FIG. 8 is a top view schematically showing an alternative embodiment of the elementary conductive pattern of FIG. 7. In pattern 81 of FIG. 8, each branch originating from a segment of the basic tripole comprises three crenel-shaped extensions of height $H_c$, extending along directions approximately orthogonal to the general branch direction, towards the outside of the pattern.

As an example, by repeating pattern 81 according to a periodic layout of the type described in relation with FIG. 4, the inventors have obtained a surface capable of shielding frequencies on the order of 0.9, 1.8 GHz, and 2.1 GHz by using the following parameters:

| Parameter | $L_s$ | $D_b$ | $D_m$ | $L_b$ | W | $L_{as}$ | $L_{ab}$ | $H_c$ |
|---|---|---|---|---|---|---|---|---|
| Value (mm) | 28.8 | 9.8 | 0.5 | 8.8 | 0.5 | 6.3 | 0.05 | 5 |

Figure 9:
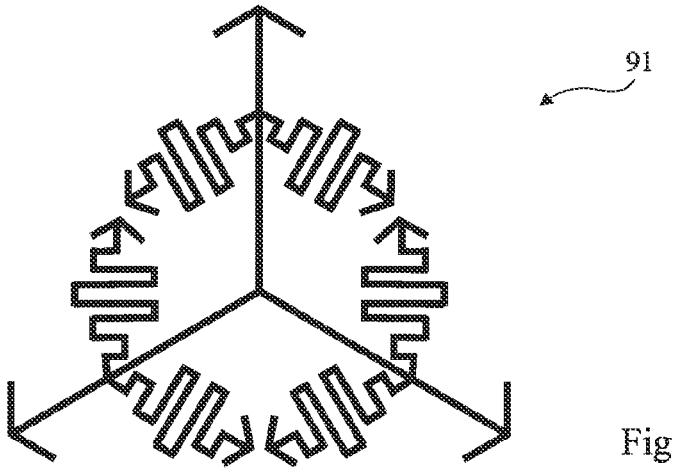

FIG. 9 is a top view schematically showing an alternative embodiment of the elementary conductive pattern of FIG. 8. In pattern 91 of FIG. 9, each branch originating from a segment of the basic tripole comprises crenel-shaped extensions of different heights, extending along directions approximately orthogonal to the general branch direction, alternately towards the outside and towards the inside of the pattern. Further, in pattern 91, the fins associated with the branches are arranged in an arrow, as in pattern 51 of FIG. 5.

Figure 10:
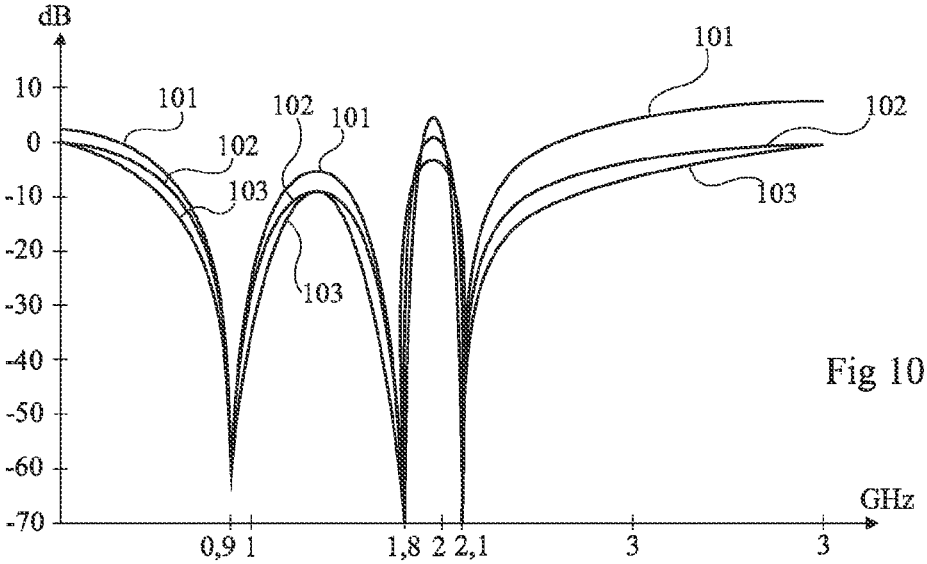
FIG. 10 is a diagram showing the frequency responses of a surface formed from the elementary pattern of FIG. 5, for elementary waves having different angles of incidence.

FIG. 10 is a diagram illustrating the variation, according to frequency, of the transmission factor (in decibels) of a surface formed by the repeating of an elementary pattern 51 of FIG. 5, for electromagnetic waves having different angles of incidence. Curves 101, 102, and 103 show the frequency responses of the surface for electromagnetic waves oriented along directions respectively forming angles of 0, 30, and 60° with the direction orthogonal to the surface plane. The selection of the parameters is such that the surface has three different resonance frequencies, respectively on the order of 0.9, 1.8, and 2.1 GHz. The diagram of FIG. 10 shows that the resonance frequencies of the surface, corresponding to negative peaks in curves 101, 102, 103, are independent from the angle of incidence of waves. It should further be noted that the resonance frequencies are also independent from the wave polarization.

According to a preferred embodiment, the frequency-selective surfaces described hereabove are formed on paper- or cardboard-type supports, for example, on wall paper, on paper or cardboard lining plasterboards lined with cardboard, or on any other support capable of lining the walls of a room of a building. The conductive patterns are for example formed by printing with conductive inks.

According to an advantage of the above-described frequency-selective surfaces, the coverage rate of the conductive patterns is relatively low, for example, smaller than 15%. This enables to maintain a relatively low manufacturing cost for such surfaces.

Specific embodiments of the present invention have been described. Various alterations, modifications, and improvements will readily occur to those skilled in the art.

In particular, the elementary conductive patterns described in relation with FIGS. 7 to 9 may give rise to several variations. However, for each of these patterns, it may be chosen to arrange the fins associated with the branches of the pattern either in an arrow, as described in relation with FIG. 5, or aligned along a same direction, as described in relation with FIG. 6. Further, it will be within the abilities of those skilled in the art to implement the desired operation by varying the number, the direction, and the orientation of the crenel-shaped extensions formed of the pattern branches.

Further, in the elementary patterns described in relation with FIGS. 3 to 9, a second generation of symmetrical branches originating from the main branches (32, 72) may be provided to increase resonance frequency setting possibilities.

The invention claimed is:

1. A surface capable of filtering a plurality of frequency bands, this surface comprising a set of separate identical elementary conductive patterns, repeated according to a periodic layout on a dielectric support, the elementary pattern comprising:

a tripole formed of three identical segments extending in a star from a center; and two branches extending symmetrically from an intermediate point of each segment, this intermediate point being located at a same distance from the center for each of the segments, the general directions of the two branches forming an angle of approximately 120° and defining an outward-pointing arrowhead, the branches associated with two different segments being non-secant, the elementary pattern being repeated by translation along each of the directions of the segments so that a same distance separates each end of a segment of a pattern from the center of a neighboring pattern.

2. The surface of claim 1, wherein the segments of the tripole form, two-by-two, angles of approximately 120°.

3. The surface of claim 1, wherein the elementary pattern further comprises two first identical fins extending symmetrically from the end of each segment, the first fins forming an angle of approximately 120° and defining an arrowhead directed towards the outside of the pattern.

4. The surface of claim 1, wherein the elementary pattern further comprises two first identical fins extending from the free end of each branch, each second fin forming an angle of approximately 60° with the general direction of the branch.

5. The surface of claim 4, wherein the second fins of each branch form together an angle of approximately 120° and define an arrowhead directed towards the outside of the pattern.

6. The surface of claim 4, wherein the second fins of each branch are aligned along a same direction, this direction intersecting the direction of the segment from which the branch originates.

7. The surface of claim 1, wherein the branches comprise at least one crenel-shaped extension along a direction intersecting the general direction of the branch.

8. The surface of claim 1, capable of filtering three frequency bands respectively centered on 0.9, 1.8, and 2.1 GHz.

9. The surface of claim 1, capable of filtering two frequency bands respectively centered on 2.4 and 5.4 GHz.

10. The surface of claim 1, wherein the dielectric support is a paper- or cardboard-type support and the conductive patterns are formed by printing with a conductive ink.

11. A use of the surface of claim 1 to filter three frequency bands located within the range from 0.9 to 5.4 GHz, wherein the overall dimensions of an elementary pattern approximately range from 1 to 10 centimeters, the lengths of each of these segments, branches, and fins being adjusted to select the three targeted frequency bands.

* * * * *